US005431196A

United States Patent [19]

Forrester, Jr. et al.

[11] Patent Number: 5,431,196

[45] Date of Patent: Jul. 11, 1995

[54] POWER REBAR TYING TOOL

[75] Inventors: Daniel W. Forrester, Jr., Chagrin Falls; Theobald J. Kauth, Macedonia; Gary J. Krasovic, Mentor, all of Ohio

[73] Assignee: Belcan Specialty Equipment Engineering Division of Belcan Engineering Groups, Inc., Solon, Ohio

[21] Appl. No.: 176,822

[22] Filed: Jan. 3, 1994

[51] Int. Cl.[6] ..... B21F 9/00

[52] U.S. Cl. ..... 140/93.6; 140/119

[58] Field of Search ..... 140/57, 93 A, 93.6, 140/119

[56] References Cited

U.S. PATENT DOCUMENTS

| | | | |
|---|---|---|---|
| 3,026,915 | 3/1962 | Jones et al. | 140/119 |
| 3,169,559 | 2/1965 | Working, Jr. | 140/119 |
| 3,211,187 | 10/1965 | Paule et al. | 140/119 |
| 3,323,558 | 6/1967 | Collins | 140/93.6 |
| 3,391,715 | 7/1968 | Thompson | 140/93.6 |
| 3,428,096 | 2/1969 | Krylov et al. | 140/93.6 |
| 3,587,668 | 6/1971 | Ward | 140/93.6 |
| 3,590,885 | 7/1971 | Ward | 140/93.6 |
| 3,593,759 | 7/1971 | Wooge | 140/93.6 |
| 3,633,633 | 1/1972 | Countryman | 140/93.2 |
| 3,880,204 | 4/1975 | Sarff et al. | 140/93 A |
| 4,117,872 | 10/1978 | Gott et al. | 140/57 |
| 4,141,389 | 2/1979 | Cöttel | 140/93 A |
| 4,177,842 | 12/1979 | Dilley | 140/93.6 |
| 4,354,535 | 10/1982 | Powell et al. | 140/93 A |
| 4,362,192 | 12/1982 | Furlong et al. | 140/93.6 |
| 4,498,506 | 2/1985 | Moody et al. | 140/93.2 |
| 4,559,977 | 12/1985 | Dilley | 140/93.6 |
| 4,577,554 | 3/1986 | Brouse | 100/26 |
| 4,655,264 | 4/1987 | Dilley | 140/93.6 |
| 4,685,493 | 8/1987 | Yuguchi | 140/119 |
| 4,762,154 | 8/1988 | Cianciullo | 140/119 |
| 4,834,148 | 5/1989 | Muguruma et al. | 140/199 |
| 4,941,515 | 6/1990 | Vrenning | 140/119 |
| 4,947,902 | 8/1990 | Lehmann et al. | 140/119 |
| 4,953,598 | 9/1990 | McCavey | 140/57 |
| 5,217,049 | 6/1993 | Forsyth | 140/93.6 |

FOREIGN PATENT DOCUMENTS

| | | |
|---|---|---|
| 0023478 | 4/1981 | European Pat. Off. . |
| 2352605 | 12/1977 | France . |

*Primary Examiner*—Lowell A. Larson

*Attorney, Agent, or Firm*—Leydig, Voit & Mayer, Ltd.

[57] ABSTRACT

A power tool for automatically tying intersecting rod-like members with wire, comprising a jaw assembly comprising a fixed jaw having an interior groove to receive wire, a moveable jaw having an interior groove to receive wire, the movable jaw being rotatable into a closed position abutting said fixed jaw, wire feed means for projecting wire through interior grooves of the jaw assembly when the movable jaw is in the closed position, an entrance groove guide for receiving wire prior to the wire entering the jaw assembly, the entrance groove guide being located between two tensioned blocks, an exit groove guide for receiving wire after the wire exits the jaw assembly, the exit groove guide being located between the tensioned blocks and oriented in such a manner so that the wire in such exit groove guide crosses the wire in such entrance groove guide, rotatable splndle means comprising a pair of cutter blades for cutting wire, wherein one of the cutter blades is rotatable, and means for twisting the ends of the wire after the wire has been cut, and motive means for operating the wire feed means and the splndle means.

5 Claims, 7 Drawing Sheets

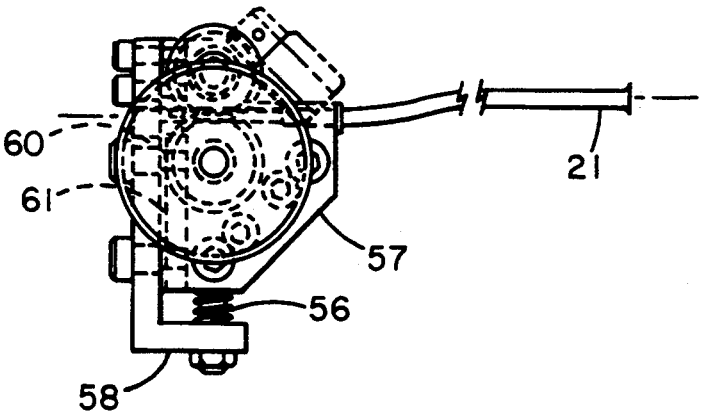
FIG. 4A
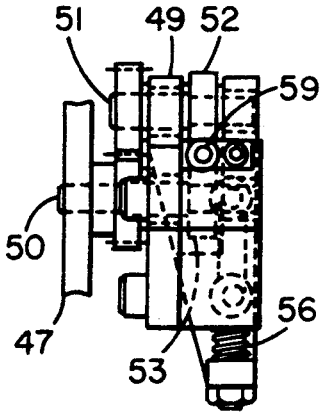
FIG. 4B
FIG. 6C
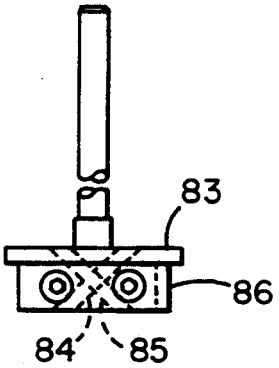
FIG 6A
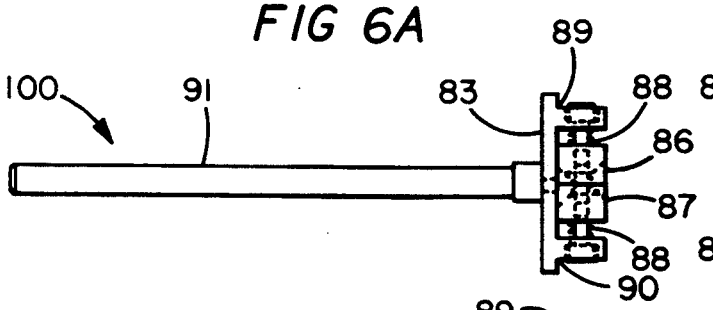
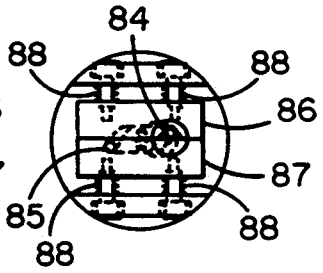
FIG. 6D
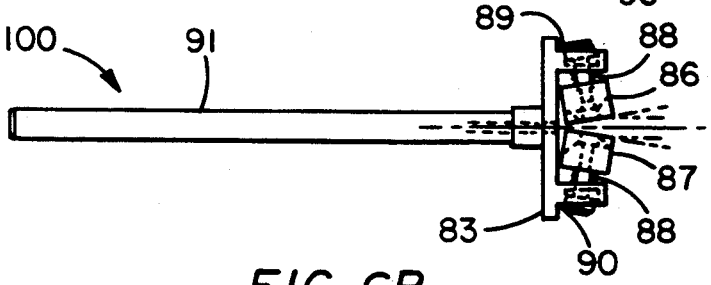
FIG. 6B

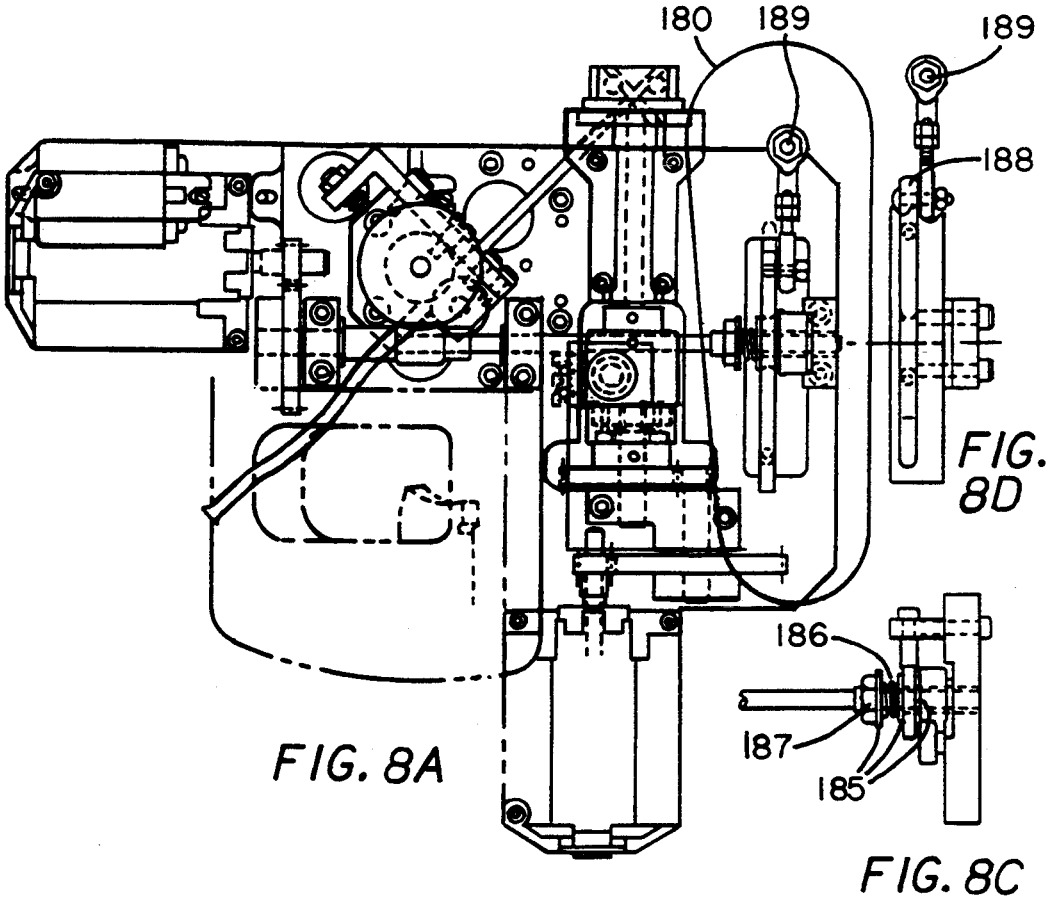
FIG. 8A
FIG. 8D
FIG. 8C
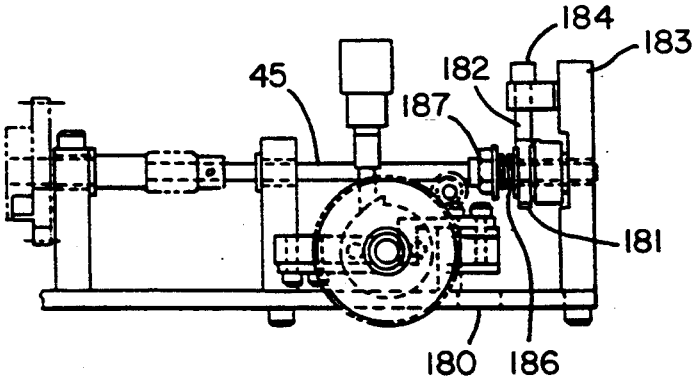
FIG. 8B

POWER REBAR TYING TOOL

FIELD OF THE INVENTION

The present invention relates generally to tools for tying wire. More particularly, this invention relates to portable, hand operated power tools for tying reinforcement bars or "rebar" used in concrete construction.

BACKGROUND OF THE INVENTION

As will be recognized by those skilled in the art, during concrete construction, arrays of reinforcement bars ("rebar") are erected within the forms so that when the concrete is poured, the resultant structure is strengthened by the rebar. Typically, intersecting sections of rebar are hand tied to each other with wire. Although it has been known in the prior art to provide various types of hand tools for tying rebar, these tools are cumbersome and unreliable, and hence are not used in the construction industry. To be effective on the job, an applicator tool must be relatively light and easy to handle. It also must be reliable, i.e., able to tie rebar consistently.

Prior art devices tend to be unreliable for several reasons. First, most prior art devices are vulnerable to imperfections in the wire, caused by metal variances, kinks and the like. As a result, the relatively inexpensive and ductile wire used for tying rebar is difficult to reliably feed with mechanical devices. Further, while the wire feed mechanism of such a device must be relatively powerful, the mechanism must not overpower the other working parts by unnecessarily forcing wire and jamming the mechanism. Second, the prior art devices do not yield, on a consistent basis, wire ties that are tight against the rebar. Those loose ties must then be tightened by hand, negating any advantages obtained by using the tool. Finally, prior art devices generally cannot be used for all rebar applications, due to the large size of the rebar encircling means on these devices.

U.S. Pat. No. 4,362,192 includes a rotating mandrel which functions in cooperation with a reciprocal jaw mechanism, but partially because the main jaws are both movable, tying problems are experienced.

U.S. Pat. No. 3,391,715 contemplates a jaw system which provide a looping mechanism, but the jaws are also both movable, leading to tying problems. It also discloses a friction drive wire feed system, which is unreliable, and utilizes clutches to operate the wire feed and looping jaw mechanisms.

U.S. Pat. No. 3,169,559 discloses a system for tying rebar which is complicated by the fact that the applicator head includes rotating ears in the critical region for wire feeding. In other words, the gear rotation and the wire feed occur transversely across an applicator region rather than at the output of a concentric system.

U.S. Pat. No. 4,834,148 discloses a reinforcement binding machine having a pair of applicator jaws and a system for tying wire, but the jaws do not include a pair of fixed members with a captured looping jaw, and the wire feeding mechanism is not concentric with respect to the rotating barrel or mandrel.

U.S. Pat. No. 4,953,598 discloses a hand-held power tool, but the applicator jaw is gear driven in a cumbersome fashion. It also utilizes a jaw assembly to cut the wire.

U.S. Pat. No. 4,498,506 discloses a wire system wherein the wire feeding mechanism is disposed in spaced relation with respect to the applicator head. The wire is fed through a cable so that the power wire feeding apparatus is unnecessarily separated from the critical applicator jaws.

U.S. Pat. No. 4,685,493 integrates the wire spool with the unit body, but does not include reciprocal jaws in the manner of the present invention, nor does it include a reliable drive feed system.

U.S. Pat. No. 4,177,842 includes a feeding mechanism with a reciprocal jaw which attempts to provide looping, but the wire feed points are not controlled through the concentric arrangement proposed by the present invention. The wire is also not crossed as it exits and enters the jaw assembly. Tight ties cannot, therefore, be reliably obtained.

The wire applicator head of U.S. Pat. No. 3,026,915 discloses a rotating mandrel in which a pair of stops can catch wires fed on opposite sides of the mandrel, but lacks the concentric wire feeding system and jaw system herein disclosed.

U.S. Pat. No. 5,217,049 does not cross the wire entering and exiting the jaw assembly. As a result, tight ties cannot reliably be obtained. Further, the wire feed mechanism is not able to feed wire with variations or defects. Clutches are also used to operate the tool, making it unreliable.

Therefore, to date, no portable, light weight tool has been available to tie wire about rebar intersections which can reliably produce tight wire ties and can reliably feed the wire. The tool of the present invention solves these problems.

OBJECTS AND SUMMARY OF THE INVENTION

Thus, a fundamental object of the present invention is to provide a portable wire tying tool useful for concrete construction or the like.

A basic object is to provide a rebar tying tool which safely and automatically installs wire ties.

More particularly, an object of this invention is to provide a rebar tying tool which quickly and reliably ties tight wire loops about vertical, horizontal, or any included angular rebar structures or similar structures.

Another object of the present invention is to provide a rebar tying tool of the character described having a reliable and simple wire feed system which can easily be used with wire of varying or uneven dimensions, and which does not jam or cause tangles. It is a feature of the present invention that the wire is stored on an external spool which can conveniently be worn on the belt of the installer.

A related object is to provide an automatic wire feed system which prevents and eliminates wire jamming in the feed section.

Another related object is to provide a tool of the character described which will reliably install imperfect wire having kinks and irregular bends.

Yet another object of the present invention is to provide a rebar tying tool of the character described which facilitates one-handed operation.

Another object is to provide a rebar tying tool of the character described which can operate from a battery pack, and thus employ direct current power without an external power cord.

A further object of the present invention is to provide a rebar tying tool with a reliable and efficient wire feeding mechanism which can handle either bare or coated wire, and which can thus be readily adapted to comply with the various local code requirements.

Another object is to provide a wire tying tool of the character described which forms no "loose ends" around the edges or ends of the tie.

Another fundamental object of the rebar tying tool is to provide an absolutely tight and reliable twist.

A still further object of the present invention is to provide a rebar tying tool of the character described which can easily receive the wire from the spool, and which will relieve the operator of the obligation to handle wire after initial feeding occurs.

These and other objects and advantages of the present invention, along with features of novelty appurtenant thereto, will appear or become apparent in the course of the following descriptive sections, and are obtained by the power rebartying tool of the present invention.

Herein disclosed is a portable, hand operated power tool for automatically tying intersecting elongated rod-like elements such as rebar used in concrete construction. The tool speedily installs precision ties of uniform quality for binding crossing rebar sections. It employs conventional rebar tying wire held by the user in a spool conveniently secured to his belt by a conventional strap. Ease of use, reliability, speed, and portability are major characteristics of the tool.

An electric drive motor system selectively energizes an electrical-mechanical mechanism disposed within a protective casing. The mechanism selectively rotates a wire feed assembly and a spindle assembly which cuts and then twists the wire. A jaw assembly projects outwardly from the casing to encircle the crossed rebar sections, and wire is fed around rebar guide grooves defined within the jaws. The jaw assembly is bolted directly to the spindle assembly.

The jaw assembly is integral with a tubular base coaxially mounted along the spindle assembly axis to the front of the tool. The center of the jaw base is penetrated by shaft portions of the spindle assembly which axially rotate therewithin. The fixed jaw assembly includes an arcuate guide groove of substantially semicircular shape to properly loop the wire. The movable jaw is displaceable between an open position, in which the jaw assembly may engage untied rebar, and a closed position where the jaws fully encircle intersecting rebar sections to be tied. The looping jaw comprises an internal groove adapted to receive and direct wire in a helical path in cooperation with the guide groove in the fixed jaw. The movable jaw comprises a boss adapted to be received within a follower notch defined in the fixed jaw to positively lock the jaw assembly during wire feeding.

As the jaws close, wire is drawn into and through the tool by rotation of the wire feed mechanism in response to its drive actuator. Wire is fed through to the jaws virtually at the center of the spindle assembly. The feed mechanism is driven by a worm gear meshed with a gear that rotates suitable knurl wheels to force wire through the spindle, around the jaws, and back into the machine.

The spindle assembly rotates in response to its drive actuator which is activated after wire looping and feeding. The spindle assembly includes an internally aligned, concentric shear disk through which wire passes for cutting. It also includes crossed entrance and exit wire groove guides.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

FIG. 2 is an enlarged, fragmentary side elevational view of the jaw assembly;

FIG. 4A is an enlarged view, with portions thereof broken away for clarity or omitted for brevity, illustrating the wire feed mechanism;

FIG. 4B is a view of details of the wire feed mechanism;

FIG. 6A is a view of the spindle assembly with wire guides and tension control features;

FIG. 6B is a view of the spindle assembly at the end of the twist cycle;

FIG. 6C is a top view of the spindle assembly;

FIG. 6D is a front view of the spindle assembly;

FIG. 8A is a top view of the rebar tool;

FIG. 8B is a view of the jaw activator assembly;

FIG. 8C is a view of the clutching mechanism of the jaw activator;

FIG. 8D is a top view of the jaw activator assembly; and

DETAILED DESCRIPTION OF THE PREFERRED EMBODIMENT

Figure 1A:
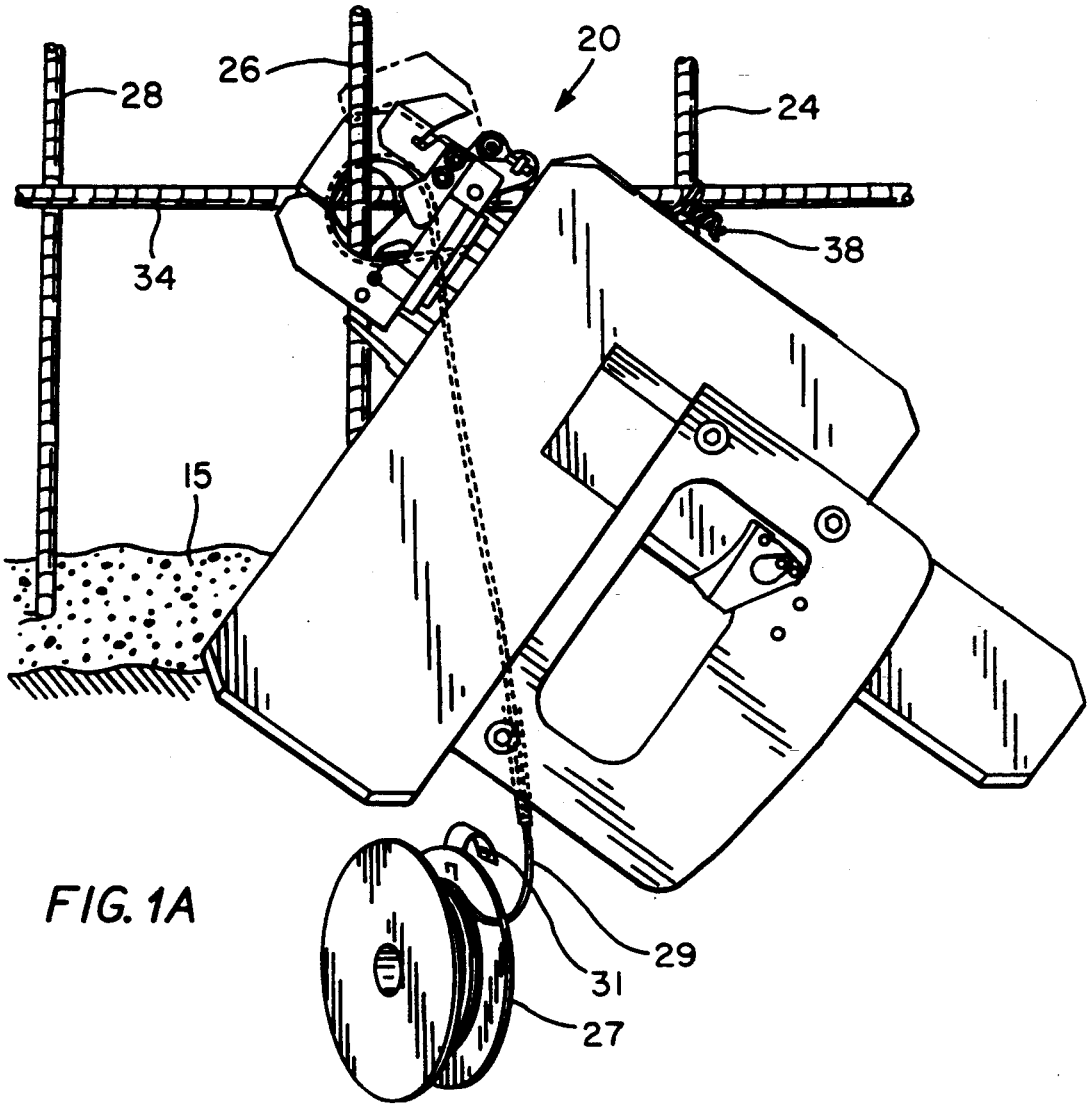
FIG. 1A is an enlarged, fragmentary perspective view illustrating the power rebar tying tool in use tying conventional concrete rebar.
Figure 1B:
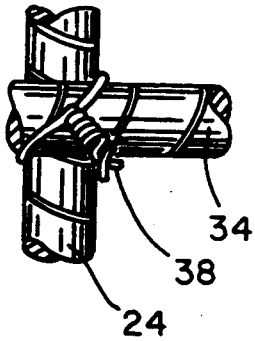
FIG. 1B shows a tied rebar section.

With initial reference directed to FIGS. 1A and 1B of the appended drawings, the power rebar tying tool has been generally designated by the reference numeral 20. Tool 20 is held in the hands 23 of an installer whose arm 22 is sufficient to control the apparatus. Conventional rebar is comprised of spaced apart reinforcement rods 24, 26, 28 which extend vertically upwardly, horizontally, or at an angle from a previously laid concrete foundation 15. A horizontal rebar crosspiece 34 which extends across rods 24, 26, 28 must be tied with wire for bracing before concrete pouring. Tool 20 rapidly and automatically installs precision twists or ties 38 (FIG. 1B) to fasten the rebar portions together. Tool 20 utilizes wire 29 conveniently stored on a conventional spool 27 reliably secured to the belt of the user by bracket 31. Tool 20 comprises three major components: (1) a wire feed assembly 40, (2) a spindle drive assembly 80, and (3) a jaw assembly 140. Each will be described in turn.

The wire feed component is shown in FIGS. 3A, 3B, 3C, 4A and 4B. It comprises a motor 41, which transfers rotary motion to motor shaft 42. The motor is preferably reversible. One such motor is available under the tradename S100L-R from Lexel. Motor shaft 42 turns a gear set comprising gears 43 and 44. The gear set in turn imparts rotary motion to shaft 45, which has worm 46 situated upon it. The gear set and shaft 45 are supported by shaft support assemblies 54 and 55. The shaft support assemblies also maintain alignment of the gear set and of shafts 41 and 45.

Worm 46 turns worm gear 47, which in turn drives gears 48 and 49. The rotation of gears 48 and 49 causes shafts 50 and 51 to also rotate, driving the knurl wheels 52 and 53 (FIG. 4B).

The knurl wheels 52 and 53 act to feed the wire into the tool 20 and through the jaw assembly 140. Knurl wheels 52 and 53 are spring loaded by knurl spring 56, to allow knurl wheels 52 and 53 to keep pressure on the wire. As a result, the wire feed assembly can accommodate variations in wire manufacture. Positive stop(s) 60 and 61 ensure continuous contact between the wire and knurl wheels 52 and 53. Knurl wheel 53 is held by fixed member 57, while knurl wheel 52 is held by slide mechanism 58, allowing knurl spring 56 to maintain wire tension (FIG. 4A). Wire enters the wire feed assembly 40 via wire feed tube 21, which terminates at wire feed entrance 59 just prior to the wire contacting knurl wheels 52 and 53.

Figure 5A:
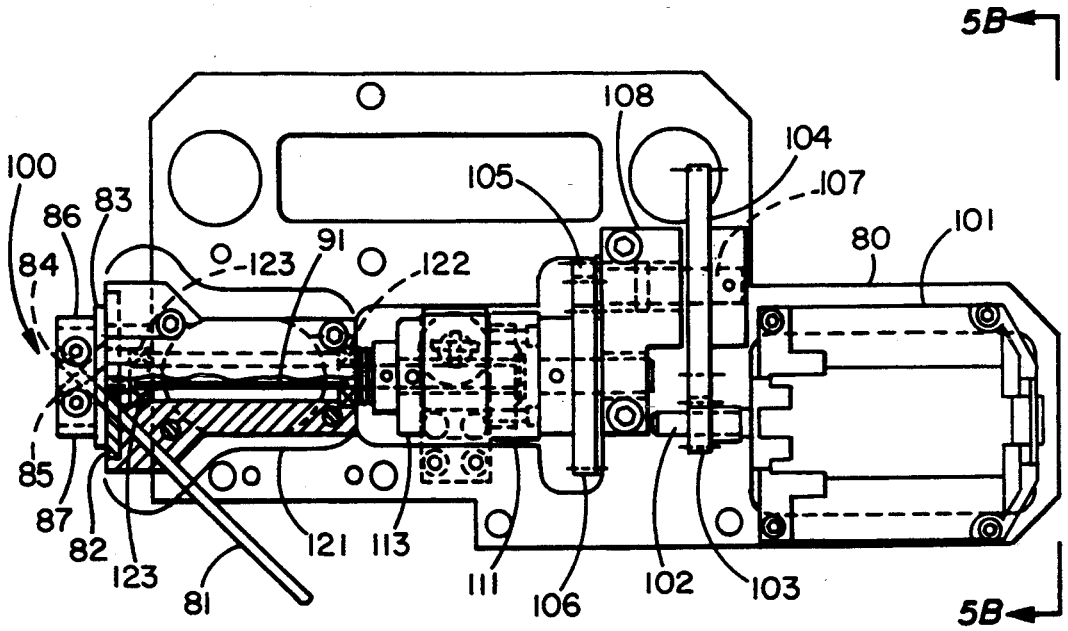
FIG. 5A is a view of the spindle and drive assemblies immediately before commencement of a wire twisting operation.
Figure 5B:
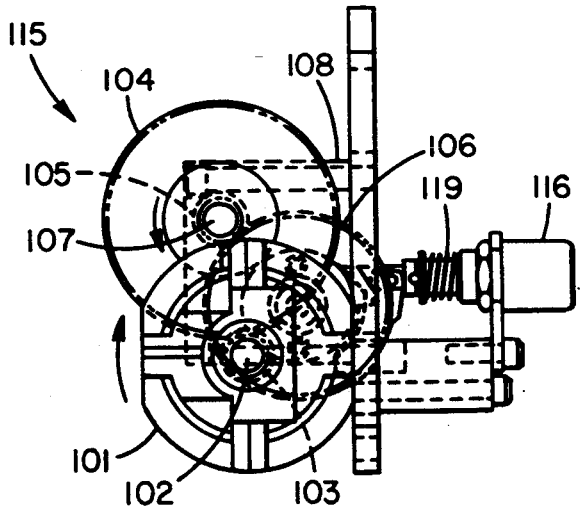
FIG. 5B is a view of the clutch activator sub-assembly.

Wire is drawn by knurl wheels 52 and 53 into wire feed tube 81 (FIG. 5A). It then passes through an orifice in stationary cutter blade 82 and an orifice in rotating cutter member 83 (FIG. 5A). The wire then feeds into wire entrance groove guide 84. Wire groove guide pass through floating twist blocks 86 and 87 (FIGS. 6A, 6B) which are disposed in a stacking relationship. The wire passes through entrance groove guide 84, and enters the jaw assembly 140. After the wire exits the jaw assembly, it enters the exit groove guide 85, which is disposed in relation to guide 84 so that the wire in exit groove guide 85 crosses over the wire in entrance groove guide 84. Like entrance groove guide 84, exit groove guide 85 also passes through floating twist blocks 86 and 87. Twist blocks 86 and 87 are held at a predetermined tension by four springs 88 (FIG. 6D). Twist blocks 86 and 87, as well as springs 88, are held in place by spindle tool 89, and spindle bottom 90.

After the wire is fed around the jaw assembly and through the exit groove guide, the motor 41 is reversed, pulling the wire from the interior wire grooves 149 and 150 of jaw assembly 140, to allow the wire to freely twist and tighten around the rebar during the operation of spindle assembly 100. Spindle assembly 100 (FIGS. 6A, 6B), which is described hereafter, begins to rotate, first cutting the wire, and then causing the cut ends of the wire to twist upon themselves. When the twisted wire reaches a predetermined tension, twist blocks 86 and 87 open (FIG. 6B), releasing the wire from the entrance and exit groove guides, ending the twist cycle. The use of tensioned twist blocks 86 and 87 to control wire tension during twisting results in tight wire ties being obtained. Spindle assembly 100 comprises spindle shaft 91, rotary cutter member 83, and spindle top and bottom 89 and 90, in addition to twist blocks 86 and 87.

The design of the exit and entrance groove guides is critical to operation of the tool. The groove must be of sufficient size to freely guide wire of varying diameter, and must allow the wire to separate from the guides when the twist blocks open. The preferred groove construction is about 0.090 inches deep, with an approximately 60° included angle.

Rotary motion is applied to spindle assembly 100 from the motor 101 of spindle drive assembly 80 (FIG. 5A). Motor 101 can be of the same type as motor 41, but need not be reversible. A motor useful in the present invention is available under the tradename 596-L from Lexel. Motor 101 imparts rotary motion to motor shaft 102, which in turn drives a double reduction gear set comprising gears 103, 104, 105, and 106. The gear ratio of the double reduction gear set should generate the proper rpm for operation of spindle assembly 100. The rpm generated must be sufficient to cut and twist the wire (at the rotary cutter member 83 of spindle assembly 100) and generally should be in the range of 600–800 rpm. Gears 103 and 104 are intermeshed and impart rotary motion from motor shaft 102 to shaft 106. Gear 105 is also connected to shaft 107, which is supported by block 108 and bushings. Gear 105 is meshed with gear 106. Clutch adapter 111 is attached to gear 106. The output side 112 (FIG. 7B) of clutch 113 is attached to clutch adapter 111, which contains a projection 114 (FIG. 7B). Projection 114 engages and disengages the clutch 113.

Figure 7A:
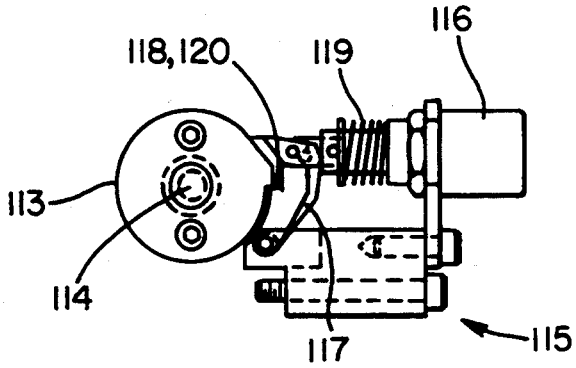
FIG. 7A shows delivery of the spindle alignment and start/stop features.
Figure 7B:
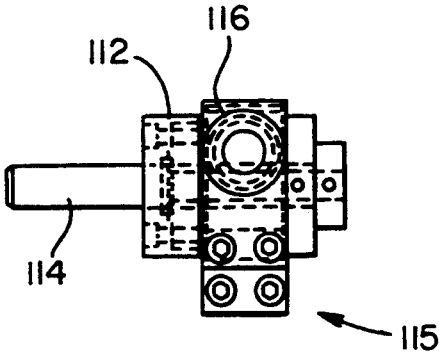
FIG. 7B is a top view of the start/stop features.

The clutch is operated by activator assembly 115, which is shown in FIGS. 7A and 7B. The activator assembly 115 comprises a solenoid 116, which operates pawl 117, which in turn engages tang 118. Spring 119 returns the solenoid to "home" position (off). When tang 118 is engaged with tang 120 on clutch 113, spindle shaft 91, which is attached to the output side 112 of clutch 113, reorients to home position and does not rotate. This realigns the cutter orifices and wire groove guides after each cycle of the tool. When the tang 120 on clutch 113 is disengaged, spindle shaft 91 rotates, which in turn rotates the rotary cutter member 83, and therefore spindle top 89 and spindle bottom 90 of spindle assembly 100, causing the wire to be cut (via operation of cutter member 83) and twisted (via operation of spindle top 89 and spindle bottom 90 in conjunction with floating twist blocks 86 and 87).

The spindle and cutter housing 121 (FIG. 5A) maintains alignment of spindle shaft 91 and the orifices in rotary cutter member 83 and stationary cutter blade 82 and supports spindle assembly 100. Two thrust members 122 are disposed between the housing 121 and clutch 113 to handle any forces developed during the start of the cut and twist cycle, and prevent shock to the spindle assembly. Two bearings 123 also carry the high loads developed during the cut and twist cycle.

Figure 2A:
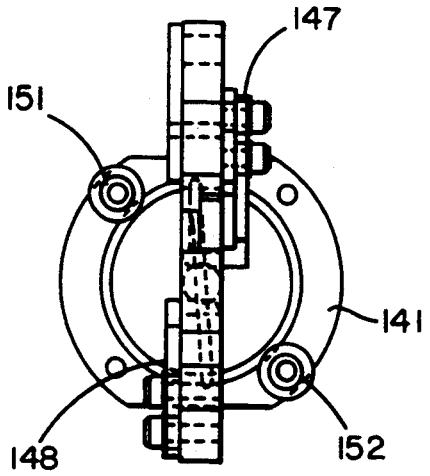
FIG. 2A is a front view of the jaw assembly.
Figure 2B:
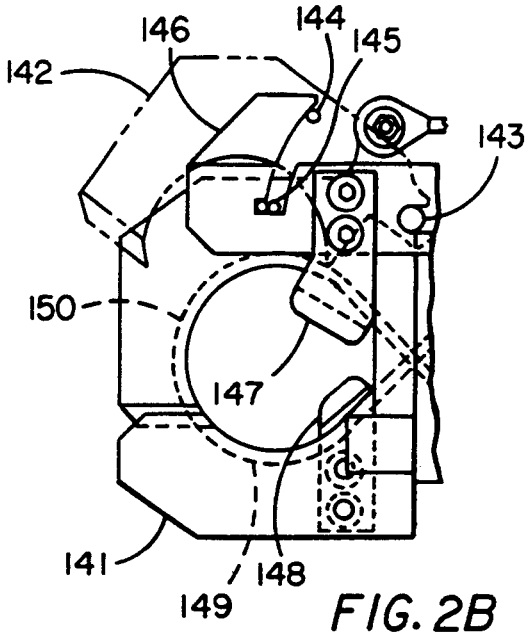
FIG. 2B is a top view of the jaw assembly.
Figure 3A:
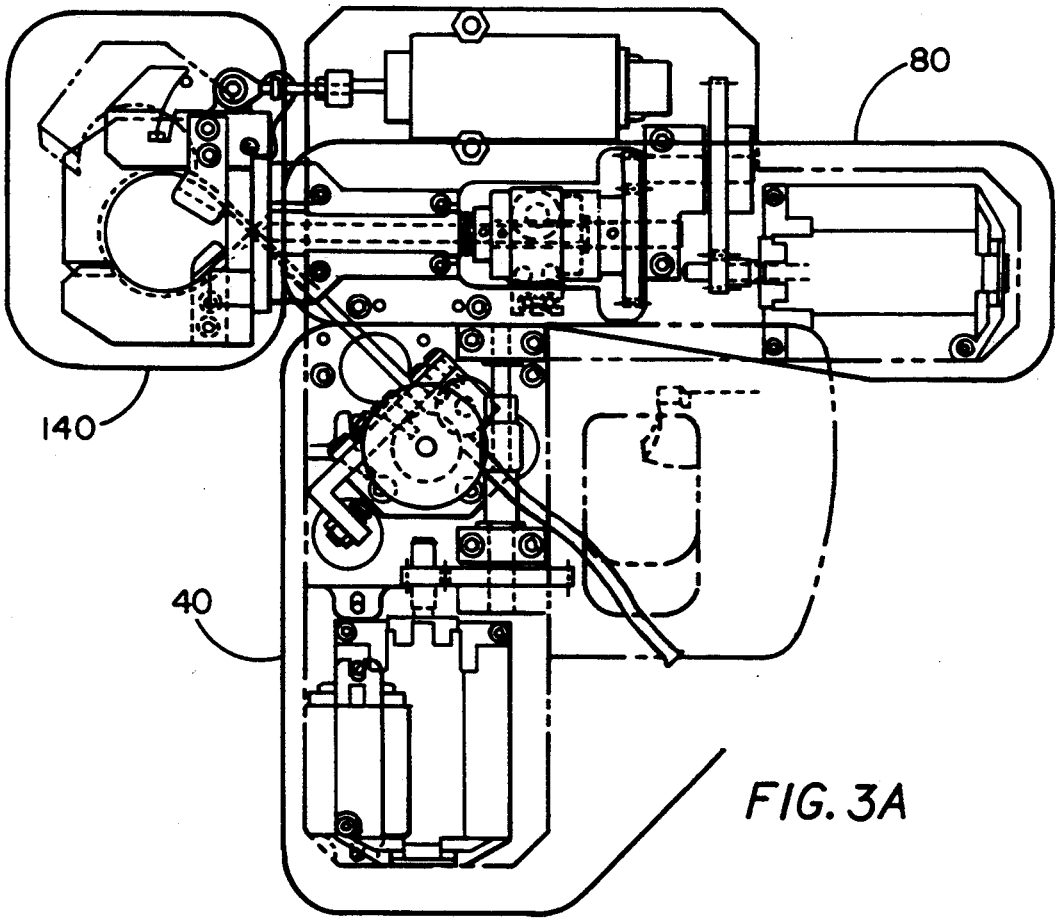
FIG. 3A is a top view of the rebar tool wire path.
Figure 3B:
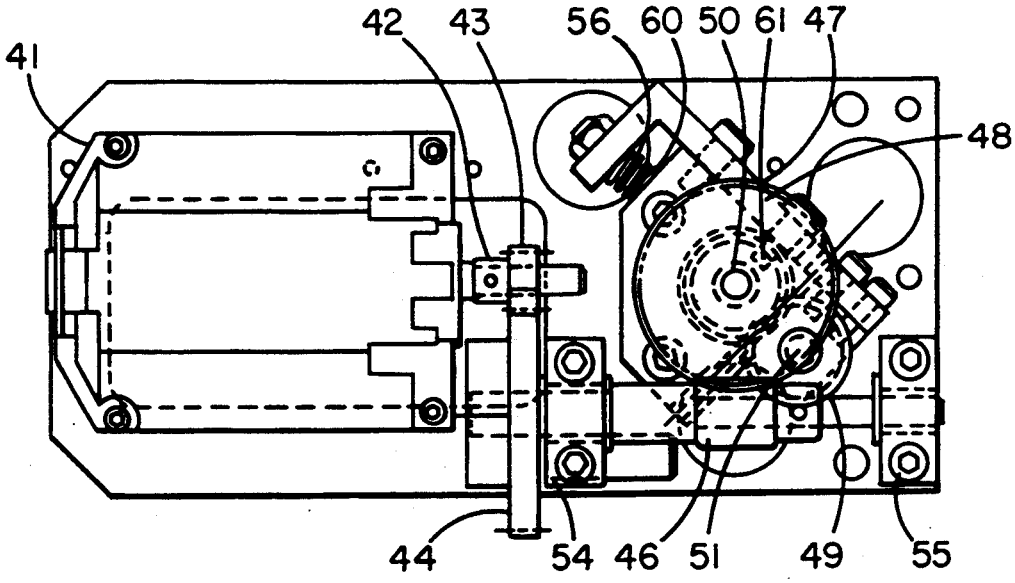
FIG. 3B is a top view of the wire feed mechanism.
Figure 3C:
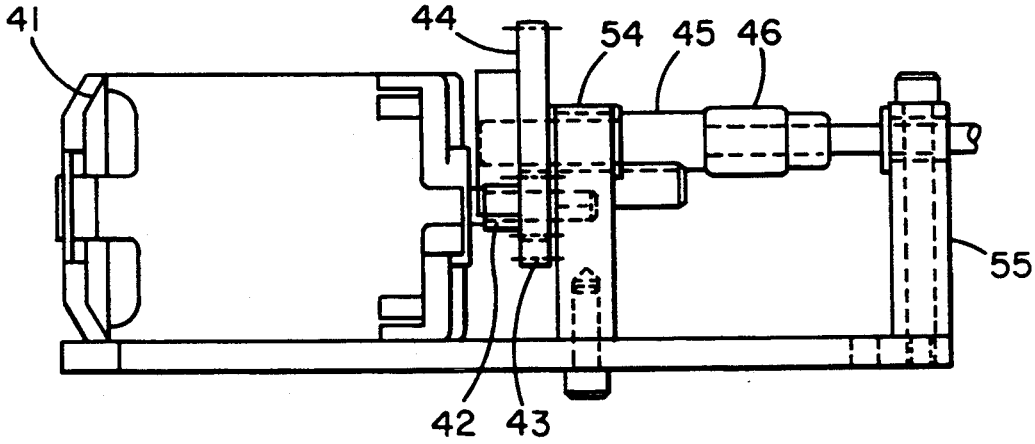
FIG. 3C is a side view of the drive for the wire feed mechanism.

The jaw assembly 140 is shown in FIGS. 2A and 2B. It comprises fixed jaw 141, and movable jaw member 142. These jaws are preferably of a size sufficient to allow the tool of the present invention to be used in all rebar tying applications. Movable jaw 142 is held in a pivoting relationship to fixed jaw 141 via dowel pin 143 in fixed jaw 141. Movable jaw 142 has a pin 144 which engages and disengages with interlock groove 145 on guide surface 146 on fixed jaw member 141. As wire enters the jaw assembly 140 from floating twist blocks 86 and 87 via entrance wire groove guide 84, it passes through wire guide 147. Similarly, as wire exits the jaw component 140, it passes through wire guide 148, and then passes through floating blocks 86 and 87 via exit wire groove guide 85. Both fixed jaw member 141 and movable jaw member 142 contain interior wire grooves 149 and 150, respectively. When the jaw assembly 140 is closed, wire travels in a circular flow pattern through grooves 149 and 150, thereby encircling the rebar to be tied. Grooves 149 and 150 have a helical orientation, so that wire passing through exit wire groove guide 85 crosses, preferably at a right angle to, wire entering jaw component 140 through entrance wire groove guide 84. As a result, during the cut and twist cycle, the wire is twisted around itself, generating a tighter and more secure tie then when the wire enters and exists the jaw component in a parallel relationship to each other.

Fixed jaw 141 also has attached to it rebar locator buttons 151 and 152 (FIG. 7A). These buttons keep tool 20 in proper orientation to the rebar during operation.

Movable jaw 142 is operated by jaw activator assembly 180 (FIGS. 8A, 8B). The jaw activator assembly 180 is operated by motor 41 of wire feed assembly 40. Motor 41 drives motor shaft 42, which in turn rotates pinion gear 181. Pinion gear 181 is meshed with rack 182, which moves either forward or back along support slide 183 in relation to the jaw assembly, depending on the rotation of the motor shaft 42.

Rack 182 is attached to support slide 183 with support screws 184. These screws 184 hold the slide 183 in place. Pinion gear 181 is friction loaded on motor shaft 41 via three thrust washers 185 and spring 186. Nut 187 is used to set the proper tension against pinion gear 181 so that the jaw assembly will consistently open and close.

Connecting link 188 is attached to rack 182, and a male and female rod end attachment 189 connects the connecting link to the movable jaw assembly 142. Since the jaw activator assembly is driven by the same motor as the wire feed assembly, these two assemblies operate in tandem. As wire is fed into the tool, the motion of the motor shaft 41 causes rack 182 to move forward, closing movable jaw 142 against fixed jaw 141. When motor 41 is in the "reverse" cycle, motor shaft 41 rotates counterclockwise, causing rack 182 to move in a direction away from movable jaw 142, thereby causing movable jaw 142 to open, and the wire to reverse feed and tighten around the rebar. While a rack and pinion jaw activator assembly is preferred due to weight considerations, a solenoid 190 (FIG. 3A) can also be used to open and close the jaw assembly.

Figure 9:
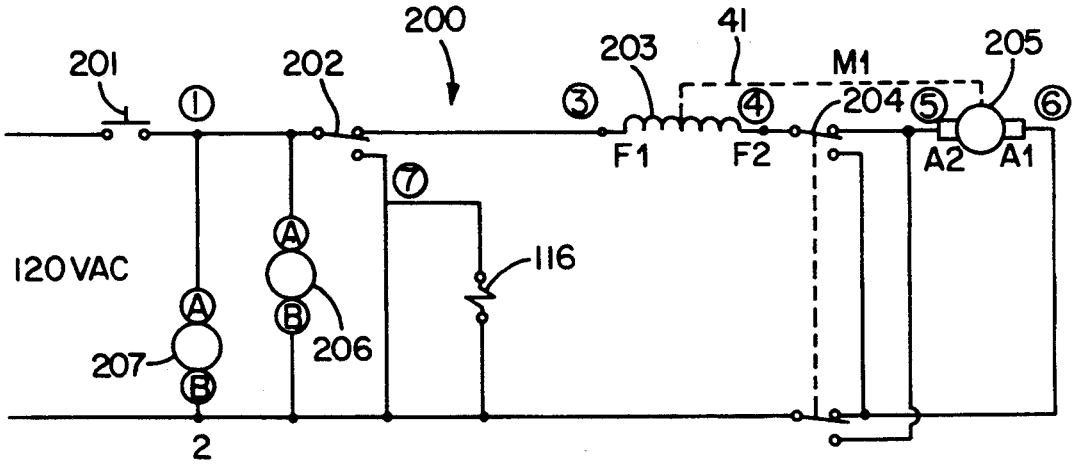
FIG. 9 is the wiring diagram for the tool.

The preferred wiring diagram 200 for the rebar tying tool of the present invention is shown in FIG. 9. When the tool trigger 201 is depressed by the user, power flows through time delay relay contact 202, through the field 203 of motor 41, and through time delay relay contact 204 into motor armature 205. At a first predetermined time, time delay relay contact 204 times out, causing time delay relay contact 204 to change state, thereby reversing the current flow through armature 205, and giving reversing action to motor 41.

At a second predetermined time, time delay relay contact 202 times out and changes state, shutting off current to motor 41. Instead, current flows to motor 101 and solenoid 116 thus energizing the spindle drive assembly. The time-out times for time delay relay contacts 202 and 204 are set by potentiometers 206 and 207, respectively. The power input to the tool of the present invention should be 120 volts (AC), 60 cycle.

Operation

The loose end of a reel of tie wire is inserted into the wire feed tube 21 until it stops, indicating that the end of the tie wire is contacting knurl wheels 52 and 53 just past the end of the wire feed entrance 59. The jaw assembly of the tool of the present invention, which is in the open position, is manually placed about the intersection of two pieces of rebar.

When the trigger 201 is depressed by the operator, current flows to motor 41, which imparts rotary motion to shaft 42. At this time, the jaw activator assembly is energized, closing the movable jaw 142. Simultaneously, wire is fed by knurl wheels 52 and 53 through wire feed tube 81, through an orifice in stationary cutter members 82, through an orifice in rotating cutter member 83, and into wire entrance groove guide 84. The wire then passes through floating twist blocks 86 and 87 via wire entrance groove guide 84 into wire guide 147 of jaw assembly 140. The wire then travels in a circular path through grooves 149 and 150 of the movable jaw 142 and fixed jaw 141, respectively. The wire next enters wire guide 148, passes through exit wire groove guide 85, in the floating twist blocks 86 and 87, in the process crossing over the wire in wire entrance groove guide 84.

Motor 141 then reverses, pulling the wire from grooves 149 and 150, and wire guides 147 and 148 and tightening the wire against the rebar intersection. Motor 101 then begins operation, activating the spindle drive assembly 80. Solenoid 116 engages clutch 113, causing spindle shaft 91 to rotate. The rotation of the spindle shaft causes rotating cutter member 53 to rotate, cutting the wire. As the spindle shaft 91 rotates, the cut wire ends held in entrance groove 84 twists upon the wire held in exit groove guide 85, producing a tight wire tie about the rebar intersection. When the twisted wire reaches a predetermined tension, floating twist blocks 86 and 87 open, releasing the wire from entrance groove guide 84 and exit groove guide 85 and ending the twist cycle. With the wire tie completed, the trigger 201 is released, stopping power to motor 101 and ending the tying cycle.

From the foregoing, it will be seen that this invention is one well adapted to obtain all the ends and objects herein set forth, together with other advantages that are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

We claim:

1. A power tool for automatically tying intersecting rod-like members with wire, comprising:

(a) a jaw assembly comprising a fixed jaw having an interior groove to receive said wire, and a moveable jaw having an interior groove to receive said wire, said movable jaw being rotatable into a closed position abutting said fixed jaw;

(b) wire feed means for projecting said wire through said interior grooves of said jaw assembly when said movable jaw is in the closed position;

(c) an entrance groove guide for receiving said wire prior to said wire entering said jaw assembly, said entrance groove guide being located between two tensioned blocks;

(d) an exit groove guide for receiving said wire after said wire exits said jaw assembly, said exit groove guide being located between said tensioned blocks and oriented in such a manner so that said wire in such exit groove guide crosses said wire in such entrance groove guide;

(e) rotatable spindle means comprising a pair of cutter members for cutting said wire, wherein one of said cutter members is rotatable, and means for twisting the ends of said wire after said wire has been cut; and (f) motive means for operating said wire feed means and said spindle means.

2. The tool of claim 1 wherein said motive means are capable of reversing the direction of said wire, thereby pulling said wire from said interior grooves of said jaw assembly so that said wire tightens around the intersection of the rod-like members prior to the operation of said spindle means.

3. The tool of claim 1, wherein said wire feed means comprises a pair of knurl wheels that are tensioned with a spring to maintain contact with said wire during the operation of said wire feed means.

4. The tool of claim 1, further comprising means for rotating said movable jaw into an open position away from said fixed jaw during operation of said spindle means and into a closed position abutting said fixed jaw during operation of said wire feed means.

5. A power tool for automatically tying intersecting rod-like members with wire, comprising:

(a) a jaw assembly comprising a fixed jaw having an interior groove to receive said wire, and a movable jaw having an interior groove to receive said wire, said movable jaw being rotatable about a projection in said fixed jaw into a closed position abutting said fixed jaw;

(b) wire feed means for projecting said wire through said interior grooves of said jaw assembly when said movable jaw is in the closed position, said wire feed means comprising a pair of knurl wheels that are tensioned with a spring to maintain contact with said wire during the operation of said wire feed means;

(c) an entrance groove guide for receiving said wire prior to said wire entering said jaw assembly, said entrance groove guide being located between two tensioned blocks carried by a rotatable spindle means;

(d) an exit groove guide for receiving said wire after said wire exits said jaw assembly, said exit groove guide being located between said tensioned blocks and oriented in such a manner so that said wire in such exit groove guide crosses said wire in such entrance groove guide;

(f) means for rotating said movable jaw into an open position away from said fixed jaw during operation of said spindle means and into a closed position abutting said fixed jaw during operation of said wire feed means;

(g) first motive means for operating said wire feed means and said means for rotating said movable jaw, said motive means being capable of reversing the direction of said wire, thereby pulling said wire from said interior grooves of said jaw assembly so that said wire tightens around the intersection of the rod-like members prior to the operation of said spindle means; and (h) second motive means for operating said spindle means.

* * * * *

UNITED STATES PATENT AND TRADEMARK OFFICE

CERTIFICATE OF CORRECTION

PATENT NO. : 5,431,196

DATED : JULY 11, 1995

INVENTOR(S) : DANIEL W. FORRESTER, JR., THEOBALD J. KAUTH AND GARY J. KRASOVIC

It is certified that error appears in the above-identified patent and that said Letters Patent is hereby corrected as shown below:

ON THE TITLE PAGE:

[56] References Cited

U.S. PATENT DOCUMENTS

"4,141,389 2/1979 Cöttel" should read -- 4,141,389 2/1979 Göttel --.

[57] ABSTRACT lines 17 and 21, delete "spindle" and substitute therefor -- spindle --.

Column 3, line 17, "rebartying" should read -- rebar tying --; and

Column 6, lines 18, "106" should read "107".

Signed and Sealed this

Thirtieth Day of January, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,431,196

DATED : JULY 11, 1995

INVENTOR(S) : DANIEL W. FORRESTER, JR., THEOBALD J. KAUTH AND GARY J. KRASOVIC

It is certified that error appears in the above-identified patent and that said Letters Patent is hereby corrected as shown below:

ON THE TITLE PAGE: Item:

[73] Assignee: Delete "Belcan Specialty Equipment Engineering Division of Belcan Engineering Groups, Inc., Solon, Ohio" and substitute therefor -- Gateway Construction Co., Inc., Chicago, Illinois --.

Signed and Sealed this

Twenty-eighth Day of May, 1996

*Attest:*

Bruce Lehman

BRUCE LEHMAN

*Attesting Officer*

*Commissioner of Patents and Trademarks*